US006404139B1

(12) United States Patent
Sasaki et al.

(10) Patent No.: US 6,404,139 B1
(45) Date of Patent: Jun. 11, 2002

(54) CIRCUIT FOR DRIVING A LIGHT EMITTING ELEMENTS DISPLAY DEVICE

(75) Inventors: Osamu Sasaki; Hiroshi Odagiri; Kazumi Sakumoto; Masafumi Hoshino; Tokuya Akase, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/609,184

(22) Filed: Jun. 30, 2000

(30) Foreign Application Priority Data

Jul. 2, 1999 (JP) ..... 11-189371

(51) Int. Cl.[7] ..... G09G 3/10
(52) U.S. Cl. ..... 315/169.3; 345/76; 345/82
(58) Field of Search ..... 315/169.1–169.4; 345/76, 77, 78, 82

(56) References Cited

U.S. PATENT DOCUMENTS 5,440,208 A * 8/1995 Uskali et al. ..... 315/169.3
5,943,031 A * 8/1999 Tokunaga et al. ..... 315/169.4
5,949,194 A * 9/1999 Kawakami et al. ..... 315/169.4

* cited by examiner

*Primary Examiner*—Don Wong
*Assistant Examiner*—Wilson Lee
(74) *Attorney, Agent, or Firm*—Adams & Wilks

(57) ABSTRACT

A current is detected through a resistor which is electrically connected in series with an FET for driving an associated one of display elements; the resultant signal is inputted to an operational amplification circuit through a capacitor to be amplified therein; and an output signal from the operational amplification circuit is converted into digital data in an A/D conversion circuit to be applied to a drive control circuit. In the drive control circuit, the amount of electric charges which have been caused to flow through the associated one of the display elements is arithmetically determined, and a period of time when the FET is kept turned ON is controlled in dependence on the amount of electric charges thus arithmetically determined.

5 Claims, 3 Drawing Sheets

CIRCUIT FOR DRIVING A LIGHT EMITTING ELEMENTS DISPLAY DEVICE

BACKGROUND OF THE INVENTION

1. Field of the Invention

The present invention relates in general to a circuit for driving a display device in which at least associated ones of display elements emit light by causing a D.C. current to flow through the at least associated ones of display elements, and more particularly to a circuit for measuring the voltage to current characteristics of the at least associated ones of display elements emitting the light to correct the driving state thereof in order to stabilize the luminance of the at least associated ones of the display elements emitting the light.

2. Description of the Related Art

The construction of a conventional circuit for driving a light emitting elements display device is shown in FIG. 5. In addition, FIG. 6 is a plan view showing an element shape of the conventional light emitting elements display device. In FIG. 5, display elements 501 to 520 are electrically connected in a matrix to one another; an output terminal of a constant current source 521 which has a switching function and from which a constant current is caused to flow is electrically connected to a positive electrode side of the display elements 501, 506, 511 and 516, respectively; an output terminal of a constant current source 522 is electrically connected to display elements 502, 507, 512 and 517, respectively; an output terminal of a constant current source 523 is electrically connected to display elements 503, 508, 513 and 518, respectively; an output terminal of a constant current source 524 is electrically connected to display elements 504, 509, 514 and 519, respectively; and an output terminal of a constant current source. 525 is electrically connected to display elements 505, 510, 515 and 520, respectively. On the other hand, a switch 526 through which a current is caused to flow into the ground is electrically connected to a negative electrode side of the display elements 501, 502, 503, 504 and 505, respectively; a switch 527 is electrically connected to the display elements 506, 507, 508, 509 and 510; a switch 528 is electrically connected to the display elements 511, 512, 513, 514 and 515, respectively; and a switch 529 is electrically connected to the display elements 516, 517, 518, 519 and 520, respectively.

As shown in FIG. 6, in a prior art example, the areas of the display elements 501 to 520 which are arranged in a light emitting elements display device 601 are identical to one another, and also the constant current sources 521 to 525 supply the display elements 501 to 520 with the currents which are equal to one another. Therefore, all of the display elements have the same current density. Many D.C. driven self-light emitting devices have the characteristics in which the amount of light emission is roughly proportional to the current, and also have the V-I characteristics which are not linear as in a resistor and which are changed due to the long term degradation and temperature changes. For this reason, in order that a constant current may be caused to flow through the associated one of the display elements, the constant voltage drive is not required, but the constant current drive is required, and hence in general, the constant current drive is carried out to suppress the fluctuation of brightness.

In addition, each of the constant current sources 521 to 525 has a switching function in order to turn ON or OFF the associated one of the display elements and hence can turn ON or OFF the associated one of the constant current sources. On the other hand, the switches 526 to 529 are successively turned ON one by one in a time sharing manner. Thus, a plurality of switches are not turned ON at the same time. For example, in order to light the display element 501, the constant current source 521 and the switch 526 are both turned ON. Likewise, all of the display elements can be selectively lighted on the basis of the combination of the constant current sources 521 to 525 and the switches 526 to 529.

By adopting the construction as described above, a large number of light emitting elements can be arranged to carry out the dot matrix display, which results in various displays being able to be carried out.

If a conventional display device and a driving circuit are employed for a watch for which the miniaturization and the low power are both required, then an extra power source voltage is required in the normal constant current drive, and also the electric power which is obtained by multiplying a difference between the power source voltage and the voltage applied to a load by a load current is lost in the form of calorification. In addition thereto, there is a limit to the size of the battery as in a watch. Therefore, since the multiplying factor for boosting the power source must be increased in terms of a circuit in the apparatus for which there is limit to the power source, this is disadvantageous in terms of the power consumption and the circuit scale.

In addition, while in order that fine characters may be displayed, the fine dot matrix display needs to be employed, and the case where the segment display is employed is more advantageous than the former in terms of the power consumption. However, in the case of the segment display, it is difficult to make the areas of the segments identical to one another. For this reason, when the display elements corresponding to the segments are driven by the constant current sources having the same current value, the current density is changed in dependence on the segments, which causes the difference in the luminance of the segments.

For the purpose of reducing the difference in the luminance of the segments, it is considered that the display elements corresponding to the segments are driven by the constant voltage drive. As a result, though the initial luminance difference can be reduced, the current is greatly changed due to the long term degradation and temperature changes and hence the luminance change is caused. Therefore, the constant voltage drive can not be adopted as long as the correction is carried out for the current.

SUMMARY OF THE INVENTION

In the light of the foregoing, the present invention has been made in order to solve the above-mentioned problems associated with the prior art, and it is therefore an object of the present invention to realize a circuit for driving a light emitting elements display device which is excellent in display quality with low power by a reducing the luminance change due to the change in the characteristics, caused by long term degradation and temperature changes, of the light emitting elements display device while obtaining the high utilization factor for a power source by driving the light emitting elements display device a constant voltage.

By utilizing the fact that each of the display elements is dynamically driven and a driving FET is repeatedly turned ON or OFF in order to obtain the stable light emission having less luminance change, a current which is being caused to flow through an associated one of the display elements is detected through a serial resistor; the resultant signal is subjected to A.C. amplification through the capacitor coupling; a difference between a peak value and a bottom value of the signal is obtained by an A/D conversion circuit to obtain the magnitude of a driving current; the driving current is multiplied by a drive ON time to obtain the supplied electric charges; and at a time point when the amount of supplied electric charges has reached a specified value, the circuit a is turned OFF. In this configuration, since the A.C. amplification does not need to be employed, the accurate current can be measured using a simple amplification circuit without any adjustments, which also contributes to the enhancement of the yield of the circuits.

In addition, at the rate of about 0.05 seconds per minute, the operation state is changed from the normal display state over to the operation mode of measuring the characteristics to carry out the current measurement; on the basis of this measurement result, a proper drive correction value is obtained; and the correction value is accumulated which is in turn read out if necessary to control the duty ratio of ON/OFF of the constant voltage drive.

Further in the operation mode of measuring the characteristics, the control made by the associated one of driving FETS is changed in an analog manner; in correspondence thereto, the current and the voltage of the associated one of the display elements are both measured; on the basis of this measurement result, a proper drive correction value is obtained; and the correction value is accumulated which is in turn read out if necessary to control the duty ratio of ON/OFF of the constant voltage drive and to detect the failure of any of the associated one of the display elements to generate a signal exhibiting the abnormality.

In addition, the operation mode of the driving FET for the associated one of the display elements is changed from the ON/OFF control for the normal display over to the constant current drive in the operation mode of measuring the V-I characteristics to subject the voltage of the associated one of the display elements to the A/D conversion, whereby it is also possible to obtain the V-I characteristics. In this configuration, though the current is not directly measured, a relatively simple circuit configuration can be obtained.

BRIEF DESCRIPTION OF THE DRAWINGS

The above and other objects as well as advantages of the present invention will become clear by the following description of the preferred embodiments of the present invention with reference to the accompanying drawings, wherein.

DETAILED DESCRIPTION OF THE PREFERRED EMBODIMENTS

The preferred embodiments of the present invention will hereinafter be described in detail with reference to the accompanying drawings.

Figure 1:
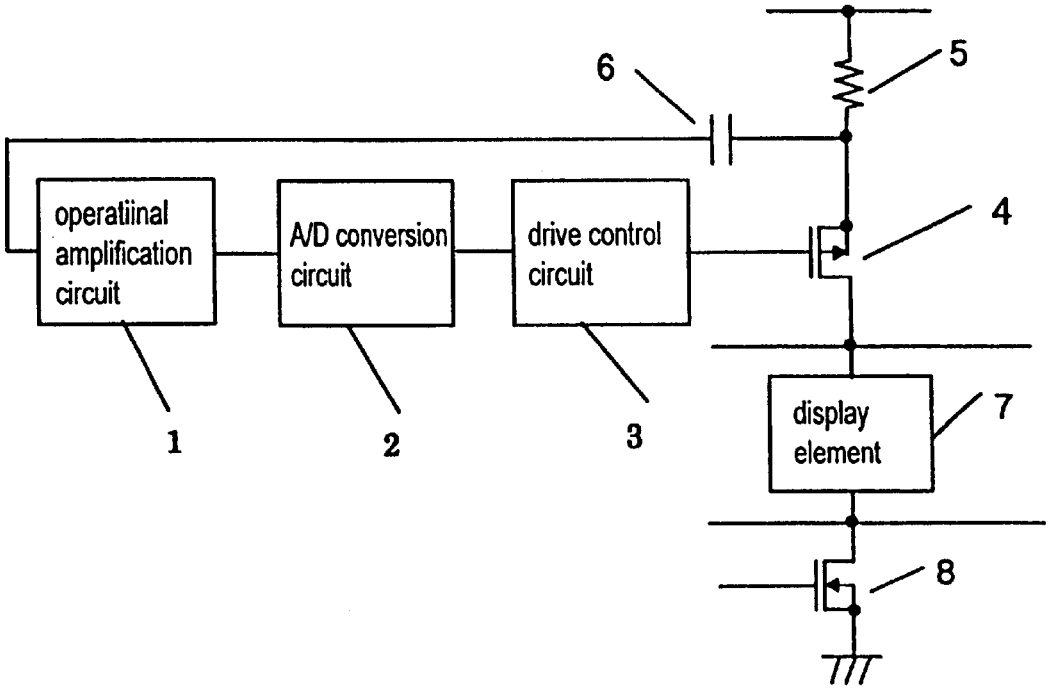
FIG. 1 is a circuit diagram, partly in block diagram, showing a configuration of an embodiment of the present invention.

FIG. 1 is a circuit diagram, partly in block diagram, showing a configuration of an embodiment of the present invention.

A drain of an FET 4 for driving a segment terminal is electrically connected to one terminal of a display element 7 and a source of the FET 4 is electrically connected to a power source through a resistor 5 through which a current is detected. A drain of an FET 8 for driving a common terminal is electrically connected to the other terminal of the display element 7, and a source of the FET 8 is electrically connected to the ground. While not illustrated in the figure, both ends of the display element are electrically connected to a plurality of display elements so that the matrix connection similar to that of the prior art example is carried out, a plurality of FETS for driving the associated ones of the segment terminals and the FET for driving the common terminal are respectively provided, and a specified display element is lighted on the basis of these ON combinations.

The circuit shown in FIG. 1 is a circuit for monitoring the electric charges which are caused to flow through the associated one of the display elements at all times. Then, for the purpose of attaining the object described above, a series resistor through which a current is detected is inserted into the power source line side having a larger number of switching FETs to monitor the electric charges in the individual display elements during the normal display operation.

When lighting the display element 7, the FETs 4 and 8 are both a turned ON to cause the current to flow through the display element 7. The electric potential difference which is proportional to that current is detected through the resistor 5. In this connection, if the resistance value of the resistor 5 is too small, then the electric potential difference becomes too small, and hence it needs to be amplified to a considerable degree, while if the resistance value of the resistor 5 is too large, then the electric potential difference becomes excessively large so that the voltage which is applied to the display element 7 becomes insufficient.

The detected voltage is applied to an operational amplifier 1 through a capacitor 6 which is electrically connected to the source of the FET 4. Since the display element 7 and the like are dynamically driven, the PET 4 does not maintain its ON or OFF state for a long period of time, and hence even in the case where the capacitor coupling is employed, the information relating to the current value can be transmitted. Since the A.C. coupling employing a capacitor is adopted and also a suitable D.C. bias is generated in the inside of the operational amplification circuit 1 in such a way that the current value information falls within the range of the input voltage of the operational amplification circuit 1, the influence by the D.C. offset and the temperature drift can be removed, and also the operational amplification circuit having a large gain can be employed with a simple configuration.

An output signal from the operational amplification circuit 1 is inputted to an A/D conversion circuit 2. A difference between a peak value (corresponding to the state in which the FET 4 is kept turned OFF and the current value is zero) of the signal which has been inputted to the A/D conversion circuit 2 and a bottom value (corresponding to the state in which the FET 4 is kept turned ON and the current is caused to flow) thereof is obtained in a drive control circuit 3 provided in the after stage of the A/D conversion circuit 2. Therefore, since the D.C. offset or the like of the AID conversion circuit 2 does not influence the display element 7, the A/D conversion circuit having an inexpensive configuration can be employed and also the circuit can be readily made free from any of the adjustments.

An output signal from the A/D conversion circuit 2 is applied to the drive control circuit 3. In the drive control circuit 3, the processing of obtaining the difference between the peak value and the bottom value of the signal is executed as in the foregoing by employing either an arithmetic circuit or a suitable software, and then the resultant difference is divided by a resistance value of the resistor 5 through which a current is detected and a suitable constant, thereby being able to be aware of the current which has been caused to flow through the display element 7. In addition, the current value is multiplied by a time for which the current is kept turned ON, thereby determining arithmetically the amount of electric charges which have been caused to flow through the display element 7. If the amount of electric charges is too much, then the control is carried out in such a way that a period of time when the FET 4 is kept turned ON is made short, i.e., the duty ratio becomes small, while if the amount of electric charges is too little, then the control is carried out in such a way that the duty ratio becomes large. In other words, the drive control circuit 3 carries out the control in such a way that the FET 4 is turned ON according to a timing signal to monitor the output signal of the AID conversion circuit 2, and then at a time point when the amount of electric charges which have been supplied to the display element 7 has reached a target value which has been previously set for each of the display elements, the FET 4 is turned OFF.

As a result, suitable electric charges are supplied to the associated one of the display elements in real time irrespective of the temperature change and the long term change.

Figure 2:
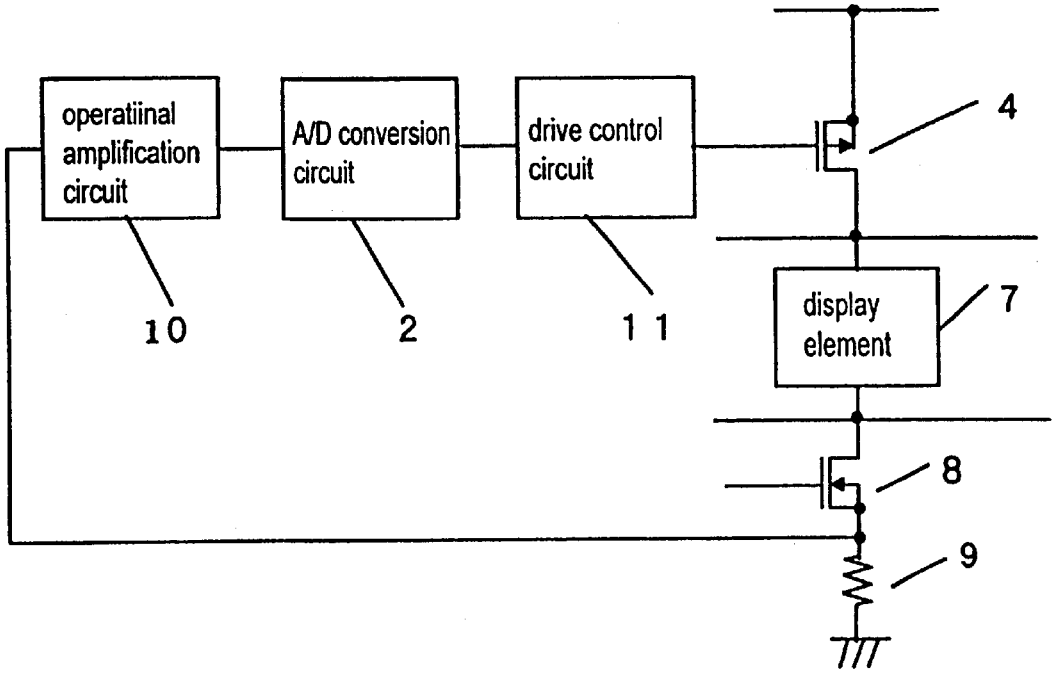
FIG. 2 is a circuit diagram, partly in block diagram, showing a configuration of another embodiment of the present invention.

FIG. 2 is a circuit diagram, partly in block diagram, showing a configuration of another embodiment of the present invention. The basic configuration for the display element 7 in the vicinity of the driving FETs is the same as that in FIG. 1, and therefore the description thereof is not given in detail here. This configuration is such that the electric charges which are caused to flow through the display elements one by one are monitored not in the normal display state, but in the operation mode of measuring a current. Then, in order to reduce the number of parts or components, a series resistor 9 through which a current is detected is inserted between the source of the FET 8 for driving the common terminal and the ground.

After the current signal which was detected through the resistor 9 has been applied to an operational amplification circuit 10 in which the range of the input voltage extends over the vicinity of the grounding electric potential to be amplified therein, it is applied to the AID conversion circuit 2. With respect to the value which has been converted into a digital data in the AID conversion circuit 2, only the value which is obtained when the current is caused to flow through the associated one of the display elements may be employed. In this connection, since the difference between the peak value and the bottom value of the signal is obtained and hence the D.C. offset, the temperature drift and the like of the operational amplification circuit 10 do not influence thereupon, the inexpensive operational amplification circuit and AID conversion circuit can be employed and also can be made free from any of the adjustments.

In this case, similarly to the drive control circuit 3 shown in FIG. 1, in a drive control circuit 11, the difference between the peak value and the bottom value of the signal is obtained and then is divided by the resistance value of the resistor 9 through which a current is detected and a suitable constant, thereby being able to be aware of the current which has been caused to flow through the display element 7. Also, the resultant value is multiplied by a period of time for which the current is kept turned ON, thereby being able to obtain the amount of electric charges which have been caused to flow through the display element 7.

If the above-mentioned arithmetic determination is carried out for one display element for an instantenous period of time of about 0.05 seconds for example right before a proper minute, when there are the sixty display elements, it is possible to confirm the amount of electric charges of all of the display elements for one hour.

Then, the amount of electric charges which have been confirmed is compared with a preset value. Then, if it is judged that the amount of electric charges which have been injected is too much, then the ON time of the FET 4 is shortened, i.e., the data which is stored in a memory and which is used to determine the ON time of the FET 4 is changed in such a way as to reduce the duty ratio, while if it is judged that the amount of electric charges is too little, then the data correction is carried out in such a way as to increase the duty ratio.

Figure 3:
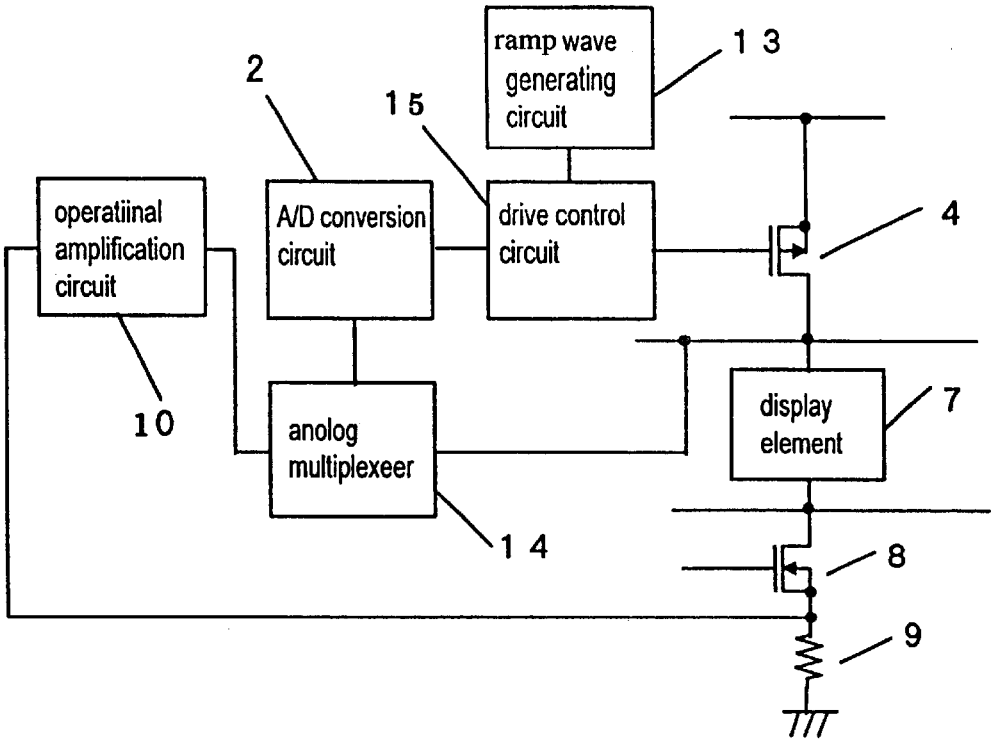
FIG. 3 is a circuit diagram, partly in block diagram, showing a configuration of still another embodiment of the present invention.

FIG. 3 is a circuit diagram, partly in block diagram, showing a configuration of still another embodiment of the present invention. In the present configuration, the detailed V-I characteristics of the display element are measured for each of the display elements, whereby it is confirmed whether the individual display elements are in a normal state or in a failure state.

The respect that the current is detected through the series resistor 9 through which a current is detected on the common terminal side, and the operational amplification circuit 10 in which the range of the input voltage extends over the grounding electric potential as well is employed is the same as that in FIG. 2. A point of difference in the configuration of FIG. 3 from FIG. 2 will herein below be described in detail.

In the operation mode of measuring the characteristics, a lamp wave having a proper amplitude is applied to the gate of the FET 4 on the segment terminal side, and also the voltage which is applied to the display element 7 is swept with time. For this reason, a ramp wave generating circuit 13 is provided and in order to reduce the number of parts or components, a square wave is applied to an RC circuit, thereby forming the ramp wave. Then, an output signal from the ramp wave generating circuit 13 is applied to a drive control circuit 15, and the signal in the normal display state and the ramp wave are changed over to each other by the drive control circuit 15, and then the resultant signal is outputted to the gate of the FET 4. In this connection, for this changing operation, the respective signals may be changed over to each other through an analog switch, or the changing operation may be carried but by the a switching of either disconnection or connection of a capacitor for converting the ramp wave.

In this connection, in order to obtain the voltage which has been applied to the display element 7, a drain voltage of the FET 4 is inputted to an analog multiplexer 14, and in addition thereto, an output signal from the operational amplification circuit 10 is also inputted to the analog multiplexer 14. Then, if necessary, the analog multiplexer 14 changes these input signals over to each other to output the resultant signal to the A/D conversion circuit 2.

The A/D conversion on the current detection side and the A/D conversion on the voltage detection side are carried out at the sufficient sampling rate, whereby it is possible to obtain the detailed V-I characteristics.

The result of the A/D conversion on the current detection side is divided by the resistance value of the series resistor 9 through which a current is detected and a suitable constant, thereby being able to be aware of the current which has been caused to flow through the display element 7. If the above-mentioned arithmetic determination is carried out for one display element for an instantenous period of time of about 0.05 seconds for example right before a proper minute, when there are the sixty display elements, it is possible to confirm the V-I characteristics of all of the display elements for one hour. Alternatively, for example, the V-I characteristics of all of the display elements may also be confirmed using a time of three seconds right before a date is changed once a day.

In the drive control circuit 15, similarly to the example shown in FIG. 2, the control for the amount of electric charges which have been supplied to the display element 7 is carried out using the V-I characteristics data which has been measured, and at the, same time, it is judged whether or not the display element 7 is in a abnormal state, and the additional correction for the amount of electric charges which have been supplied to the display element 7 is carried out. Or, a failure signal exhibiting the failure of the display element is generated to warn a user of the failure of the display element.

Figure 4:
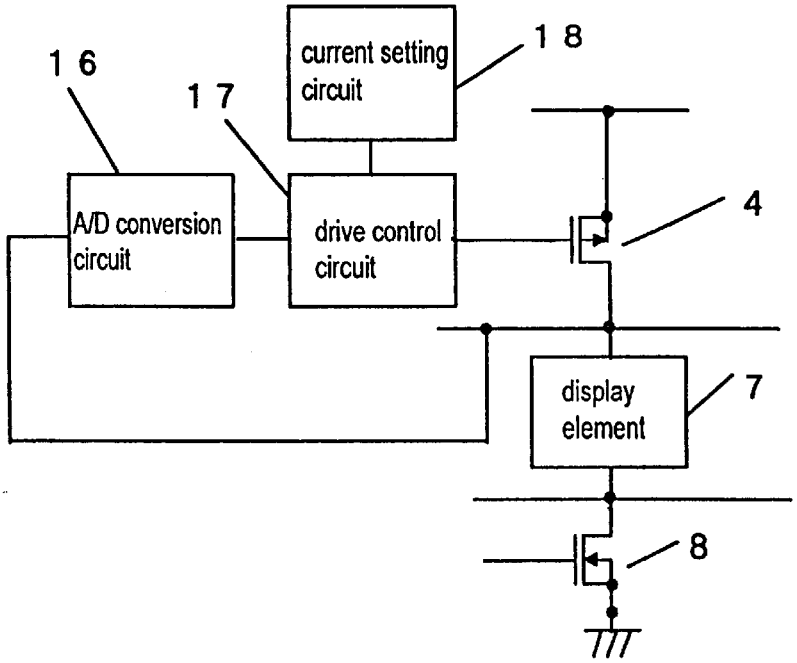
FIG. 4 is a circuit diagram, partly in block diagram, showing a configuration of yet another embodiment of the present inventions
Figure 5:
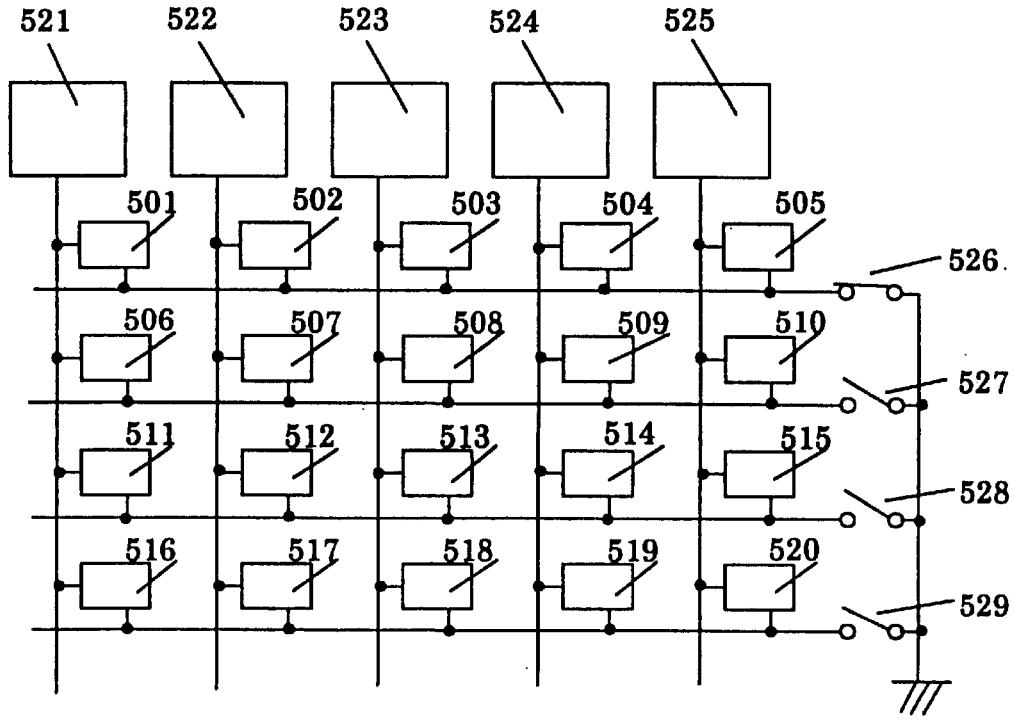
prior art Fig. 5
FIG. 5 is a circuit diagram showing a construction of a prior art example.
Figure 6:
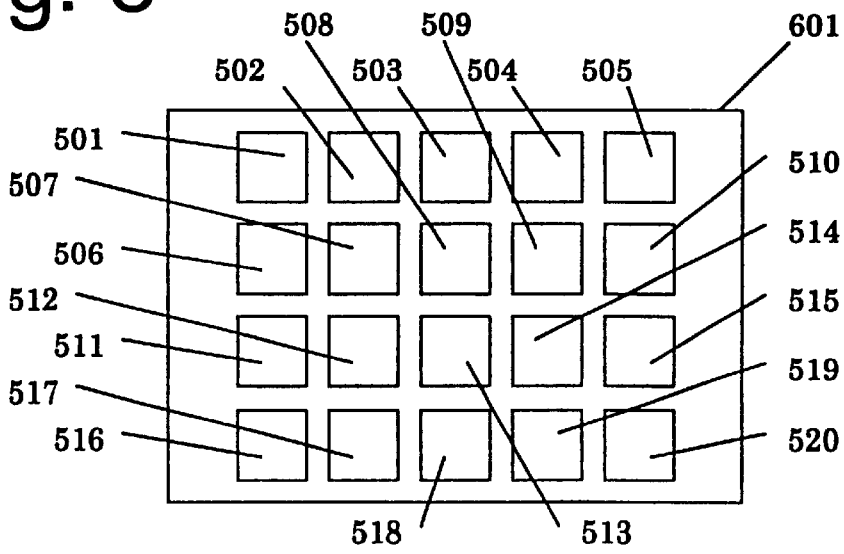
prior art Fig. 6
FIG. 6 is a plan view showing a construction of a light emitting elements display device of the prior art example.

FIG. 4 is a circuit diagram, partly in block diagram, showing a configuration of yet another embodiment of the present invention. The configuration for the display element 7 in the vicinity of the driving FET is the same as that shown in FIG. 3 or the like, only that no resistor through which a current is detected is provided. A drive control circuit 17, in the normal display state, carries out the ON/OFF control for the FET 4, while in the operation mode of measuring the characteristics, receives the voltage which has been generated in a current setting circuit 18 to apply that voltage to the gate of the FET 4 such that a constant current having a suitable value is supplied to the display element 7. The voltage of the display element 7 at this time is applied to an A/D conversion circuit 16 and then the conversion result is inputted to the drive control circuit 17. Then, the value corresponding to the conversion result is compared with a preset target value, and an optimal correction value of the data which is used to determine the ON time of the FET 4 is arithmetically determined in order to correct the error, thereby changing the data. As a result, the light emission luminance in the normal display state can be corrected to be stabilized.

While in the above description, the resistor is employed as the current detecting device, alternatively, a non-linear semiconductor device or the like may also be employed. In addition, it is also possible that the current is integrated using a capacitor which has been short-circuited by an FET switch at the start of detecting a current to detect the amount of electric changes.

In addition, while the description has been given with respect to the specific case where the characteristics are measured for all of the display elements which are employed in the actual display, alternatively, it is conceivable that the characteristics are measured for only several typical display elements. In addition, it is also possible that dummy display elements are provided in which the emitted light therefrom is masked, and the characteristics are measured for only the dummy display elements.

In addition, while the description has been given with respect to the method wherein the electric charges which are supplied to the display element 7 are controlled on the basis of the ON time of the FET 4, alternatively, it is also possible to control the power source voltage of the FET 4.

In addition, while in the above description, one terminal of the display element is provided with only one FET to carry out the open-drain type of drive, alternatively, a configuration of a complementary type of inverter may also be adopted.

By adopting a circuit for driving a light emitting elements display device, it is possible to correct the luminance change due to the characteristics change resulting from the long term change of the display elements and the temperatures while maintaining a high utilization factor of a power source offered by the constant voltage drive. For this reason, it is effective that the present invention is applied to a watch or the like which has the low power and for which a high display quality is required.

In addition, a difference between a peak value and a bottom value of a voltage which is used to detect a current to make a signal processing system easy to be configured; the measurement of the characteristics is not carried out at all times, but the sampling processing is executed instead thereof; and the characteristics are measured for only specific segments, whereby the number of parts or components constituting the detection system is reduced, and also the effective stabilization of luminance becomes possible with a relatively simple configuration. Thus, the effects which are offered by adopting the present invention are great.

While the present invention has been particularly shown and described with reference to the preferred embodiments and the specified modifications thereof, it will be understood that the various changes and other modifications will occur to those skilled in the art without departing from the scope and true spirit of the invention. The scope of the invention is therefore to be determined solely by the appended claims.

What is claimed is:

1. A circuit for driving a light emitting elements display device, comprising: a driving transistor for supplying a current to an associated one of display elements; a current detecting device electrically connected in series with the driving transistor; an amplification circuit to which a signal which has been detected by said current detecting device is inputted through an alternating current coupling; an A/D conversion circuit for converting an output signal from said amplification circuit into a digital value; and a drive control circuit connected to the amplification circuit for controlling the driving transistor to suppress the change in luminance of said associated one of the display elements.

2. A circuit for driving a light emitting elements display device according to claim 1, further comprising an arithmetic circuit for obtaining a difference between a peak value and a bottom value of the output value of the A/D conversion circuit corresponding to an ON time and an OFF time of said driving transistor to suppress the change in luminance of the associated one of the display elements.

3. A circuit for driving a light emitting elements display device, comprising: a driving transistor for supplying a current to an associated one of display elements; a current detecting device which is electrically connected in series with said driving transistor; an amplification circuit for amplifying a signal which has been detected by said current detecting device; an A/D conversion circuit for converting an output signal from said amplification circuit and a voltage of said associated one of the display elements into digital values, respectively; and a drive control circuit for controlling the operation of said driving transistor, wherein the driving state of said driving transistor is changed in an analog manner; a current which is caused to flow through said driving transistor and a voltage are measured on the basis of the output signal from said A/D conversion circuit; the state of said associated one of the display elements is judged; and the driving state of said driving transistor is corrected to suppress the change in luminance of said associated one of the display elements and to detect whether or not said associated one of the display elements is in an abnormal state.

4. A circuit for driving a light emitting elements display device, comprising: a driving transistor for supplying a current to an associated one of display elements; an A/D conversion circuit for converting a voltage of said associated one of the display elements into a digital value; and a drive control circuit for controlling the operation of said driving transistor, wherein the operation of said driving transistor is switched to the roughly constant current operation; and the driving state of said driving transistor is corrected on the basis of the voltage of said associated one of the display elements at that time to suppress the change in luminance of said associated one of the display elements.

5. A circuit for driving a light emitting elements display device according to claim 1, wherein said drive control circuit switches the driving state of said driving transistor from the normal display state to the operation mode of measuring the characteristics of said associated one of the display elements, and the driving state of said driving transistor is corrected on the basis of the result of measuring the characteristics of said associated one of the display elements to suppress the change in luminance of said associated one of the display elements.

* * * * *